US008570237B2

(12) United States Patent
Brown et al.

(10) Patent No.: US 8,570,237 B2
(45) Date of Patent: Oct. 29, 2013

(54) MULTI-BAND ELECTRONICALLY SCANNED ARRAY ANTENNA

(75) Inventors: Matthew D. Brown, Allen, TX (US); George F. Barson, Plano, TX (US); William P. Hull, Jr., Fairview, TX (US); Steven P. Mcfarlane, Mckinney, TX (US); James S. Wilson, Hurst, TX (US); Karl L. Worthen, Dallas, TX (US); Joshua Lamb, Garland, TX (US); Thomas H. Taylor, Wylie, TX (US)

(73) Assignee: Raytheon Company, Waltham, MA (US)

( * ) Notice: Subject to any disclaimer, the term of this patent is extended or adjusted under 35 U.S.C. 154(b) by 302 days.

(21) Appl. No.: 13/019,108

(22) Filed: Feb. 1, 2011

(65) Prior Publication Data

US 2012/0194406 A1 Aug. 2, 2012

(51) Int. Cl.
*H01Q 3/24* (2006.01)

(52) U.S. Cl.
USPC ..... 343/876; 343/907

(58) Field of Classification Search
USPC ..... 343/876
See application file for complete search history.

(56) References Cited

U.S. PATENT DOCUMENTS

| | | | | |
|---|---|---|---|---|
| 4,689,627 | A * | 8/1987 | Lee et al. | 342/373 |
| 5,160,936 | A | 11/1992 | Braun et al. | |
| 5,307,077 | A * | 4/1994 | Branigan et al. | 343/720 |
| 6,005,531 | A * | 12/1999 | Cassen et al. | 343/853 |
| 7,109,935 | B2 * | 9/2006 | Saint Clair et al. | 343/725 |
| 7,808,427 | B1 * | 10/2010 | Sarcione et al. | 342/188 |
| 7,817,099 | B2 * | 10/2010 | Wu et al. | 343/872 |
| 2002/0171601 | A1 | 11/2002 | Puente Baliarda | |
| 2005/0024262 | A1 * | 2/2005 | Cantrell et al. | 342/175 |
| 2008/0204350 | A1 | 8/2008 | Tam et al. | |

FOREIGN PATENT DOCUMENTS

| | | | |
|---|---|---|---|
| EP | 0 621 654 | A2 | 10/1994 |
| JP | 01-079816 | | 2/1991 |
| JP | 07-079116 | A | 3/1995 |
| JP | 2003-513496 | A | 4/2003 |
| JP | 2010-507929 | A | 3/2010 |

(Continued)

OTHER PUBLICATIONS

Extended European Search Report for European Application No. 11190955.2, Extended European Search Report dated Mar. 16, 2012 and mailed Mar. 23, 2012 (6 pgs.).
Japan Office Action mailed Apr. 23, 2013 from Corresponding Japan Application No. 2011-261844, filed Nov. 30, 2011 and Published Aug. 23, 2012 as Publication No. 2012-161070 (3 pgs.).

(Continued)

*Primary Examiner* — Jerome Jackson, Jr.
*Assistant Examiner* — Andrea Lindgren Baltzell
(74) *Attorney, Agent, or Firm* — Christie, Parker & Hale, LLP

(57) ABSTRACT

A multi-band electronically scanned array antenna including a first sub-assembly having electronic circuits for a first frequency band; a second sub-assembly mechanically coupled to the first sub-assembly and having electronic circuits for a second frequency band; and an aperture adjacent to the first sub-assembly, the aperture being shared by the first sub-assembly and the second sub-assembly. The array antenna may further include a band switching circuit, or a combining circuit for coupling the first sub-assembly or the second sub-assembly to the aperture. The array antenna may also include a third sub-assembly including electronic circuits for a third frequency band. In this way, the aperture is shared by the first sub-assembly, the second sub-assembly, and the third sub-assembly to provide a smaller and lighter array antenna.

20 Claims, 6 Drawing Sheets

(56) References Cited

FOREIGN PATENT DOCUMENTS

| | | | |
|---|---|---|---|
| WO | WO 98/37592 | | 8/1998 |
| WO | WO 01/31747 | A1 | 5/2001 |
| WO | WO 2008/036469 | A1 | 3/2008 |

OTHER PUBLICATIONS

English Translation of Japan Office Action mailed Apr. 23, 2013 from Corresponding Japan Application No. 2011-261844, filed Nov. 30, 2011 and Published Aug. 23, 2012 as Publication No. 2012-161070 (3 pgs.).

* cited by examiner

MULTI-BAND ELECTRONICALLY SCANNED ARRAY ANTENNA

FIELD OF THE INVENTION

The present invention relates generally to antennas and more specifically to a multi-band antenna.

BACKGROUND

An antenna is a transducer, which transmits or receives electromagnetic waves. Antennas include one or more elements, which are conductors that can radiate and or receive electromagnetic waves. These elements are often referred to as radiators with a collection of radiators referred to as an aperture. When transmitting, an alternating current is created in the element(s) by application of a voltage at the terminals of the antenna, which causes the element(s) to radiate an electromagnetic field. When receiving, an electromagnetic field from a remote source induces an alternating current in the elements generating a corresponding voltage at the terminals of the antenna.

FIG. 1 shows a diagram of a conventional antenna array 100. The antenna array 100 includes several linear arrays 104 housed in a non-metallic radome 102. Here, each linear array 104 is arranged vertically with spacing between each other, which is determined by the desired resonant frequency of the antenna array 100. Each linear array 102 is connected to its associated radio frequency (RF) electronics circuitry contained in an external RF electronics module 108, via an antenna feed 106. The RF electronics module 108 is connected to external systems via a connection 110 for power, control, and communications connections; and may be physically mounted on the radome 102, or may be located remotely or outside of the antenna array 100.

An Electronically Scanned Array (ESA) is a type of phased array antenna, in which transceivers include a large number of solid-state transmit/receive modules. In ESAs, an electromagnetic beam is emitted by broadcasting radio frequency energy that interferes constructively at certain angles in front of the antenna.

Modern Radar, Jammer and Communications antenna systems often require wideband frequency capability within constrained volume allocations. Electronically Scanned Array (ESA) antenna designs provide dense-packed, high-reliability electronics, but ESA component limitations typically require that wideband frequency applications be broken up into multiple bands for hardware implementation. These bandwidth-limited components may include circulators, power amplifiers, or manifolding, and wideband partitioning typically results in the need for multiple antenna assemblies with each additional antenna requiring volume, weight, and cost allocations.

Typical wideband antenna applications use separate antenna assemblies for each performance frequency band as shown in FIG. 2, but each additional antenna requires additional volume, weight, and cost allocations. FIG. 2 illustrates two antenna array assemblies for two different bands, according to conventional approaches. As depicted, one antenna assembly including its own aperture is used for band 1 and a separate antenna assembly including its own aperture is used for band 2.

The present invention provides a solution to the wideband antenna application problem by packaging multi-band electronic layers in one antenna assembly using a shared aperture.

SUMMARY OF THE INVENTION

In some embodiments, the present invention is a multi-band electronically scanned array antenna. The array antenna includes a first sub-assembly including electronic circuits for a first frequency band; a second sub-assembly mechanically coupled to the first sub-assembly and including electronic circuits for a second frequency band; and an aperture adjacent to the first sub-assembly, the aperture being shared by the first sub-assembly and the second sub-assembly.

The array antenna may further include a band switching circuit, or a combining circuit for coupling the first sub-assembly or the second sub-assembly to the aperture. The array antenna may also include a third sub-assembly including electronic circuits for a third frequency band. In this way, the aperture is shared by the first sub-assembly, the second sub-assembly, and the third sub-assembly to provide a smaller and lighter array antenna.

In some embodiments, the present invention is a multi-band electronically scanned array antenna. The array antenna includes a first sub-assembly including a first transmitter/receiver circuit for transmitting and receiving a first frequency band; a second sub-assembly mechanically coupled to the first sub-assembly and including a second transmitter/receiver circuit for transmitting and receiving a second frequency band; an aperture adjacent to the first sub-assembly, the aperture being shared by the first sub-assembly and the second sub-assembly; and a band switching circuit coupled between the first and second sub-assemblies and the aperture for electrically coupling the first sub-assembly or the second sub-assembly to the aperture. Optionally, the first sub-assembly may include a first circulator and the second sub-assembly may include a second circulator. Optionally, the first sub-assembly may include a first transmitter/receiver switch and the second sub-assembly may include a second transmitter/receiver switch.

The band switching circuit may be user-selectable. Further, a cover may be coupled to the second sub-assembly. The array antenna may be an Active Electronically Scanned Array (AESA) antenna, or a Passive Electronically Scanned Array (PESA) antenna.

DETAILED DESCRIPTION

Figure 1:
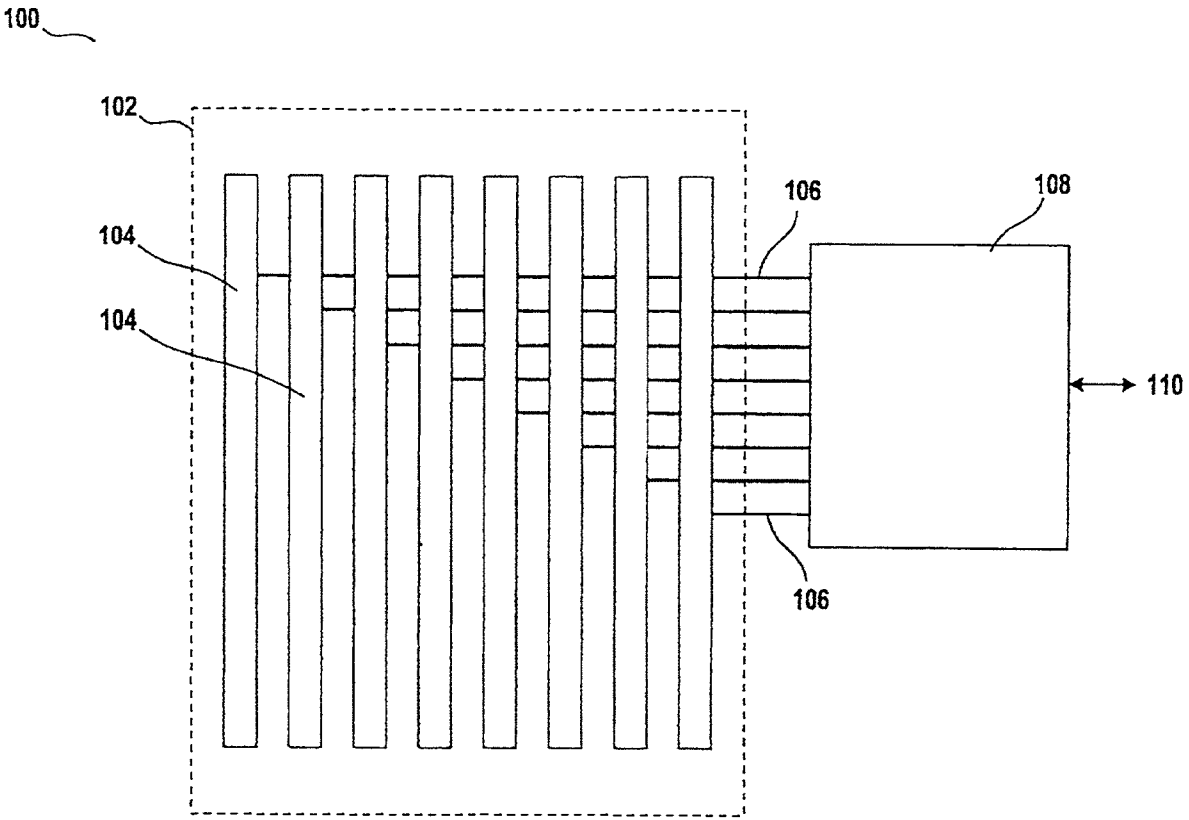
FIG. 1 (PRIOR ART)
FIG. 1 shows a diagram of a conventional antenna array.
Figure 2:
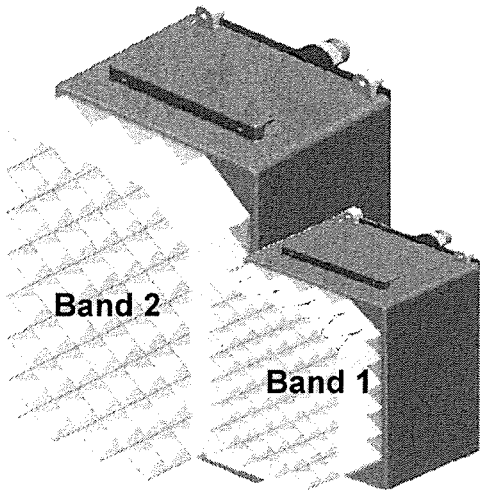
FIG. 2 (PRIOR ART)
FIG. 2 illustrates two array antennas for two different bands, according to prior art.

In the following detailed description, only certain exemplary embodiments of the present invention are shown and described, by way of illustration. As those skilled in the art would recognize, the invention may be embodied in many different forms and should not be construed as being limited to the embodiments set forth herein. Like reference numerals designate like elements throughout the specification.

In some embodiments, the present invention is a multi-band antenna that packages electronics components in compressed-depth layers behind a shared aperture. This packaging approach provides wideband, dual polarization capability using multi-band electronics layers behind a shared aperture without the additional volume, weight, and cost of the multiple antenna assemblies approach. Although, the examples utilized in this disclosure mainly refer to an AESA antenna, the present invention is applicable to a variety of different types of radar antenna, including Passive Electronically Scanned Array (PESA) antenna designs, and the like.

Figure 3:
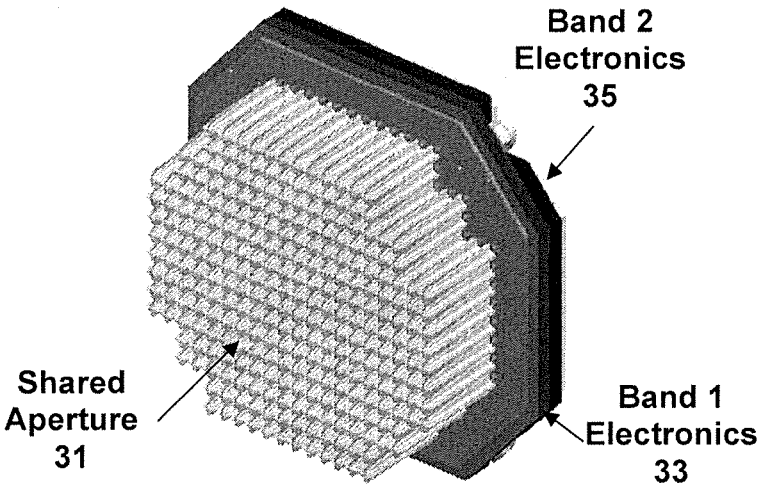
FIG. 3 is a simplified diagram of a combined multi-band antenna assembly, according to some embodiments of the present invention.

FIG. 3 is a simplified diagram of a combined multi-band antenna assembly, according to some embodiments of the present invention. Band 1 electronics assembly 33 and band 2 electronic assembly 35 share a shared aperture 31. Although, this example is directed to two bands for simplicity, the present invention is not limited to two bands and is applicable to several bands, with each band having its own electronics. Depending on which band is to be used, a band switch (FIG. 5) or in some embodiments, a combiner (FIG. 6) may be used to electrically couple the respective electronics to the shared aperture. The combiner approach allows for simultaneous use. Once electrically coupled to the shared aperture, the selected band operates in the desired frequency band. The band switch is selectable by the user, or mission software. In some embodiments, the band switch or combiner is (remotely) selectable (programmable) by the user.

Figure 4:
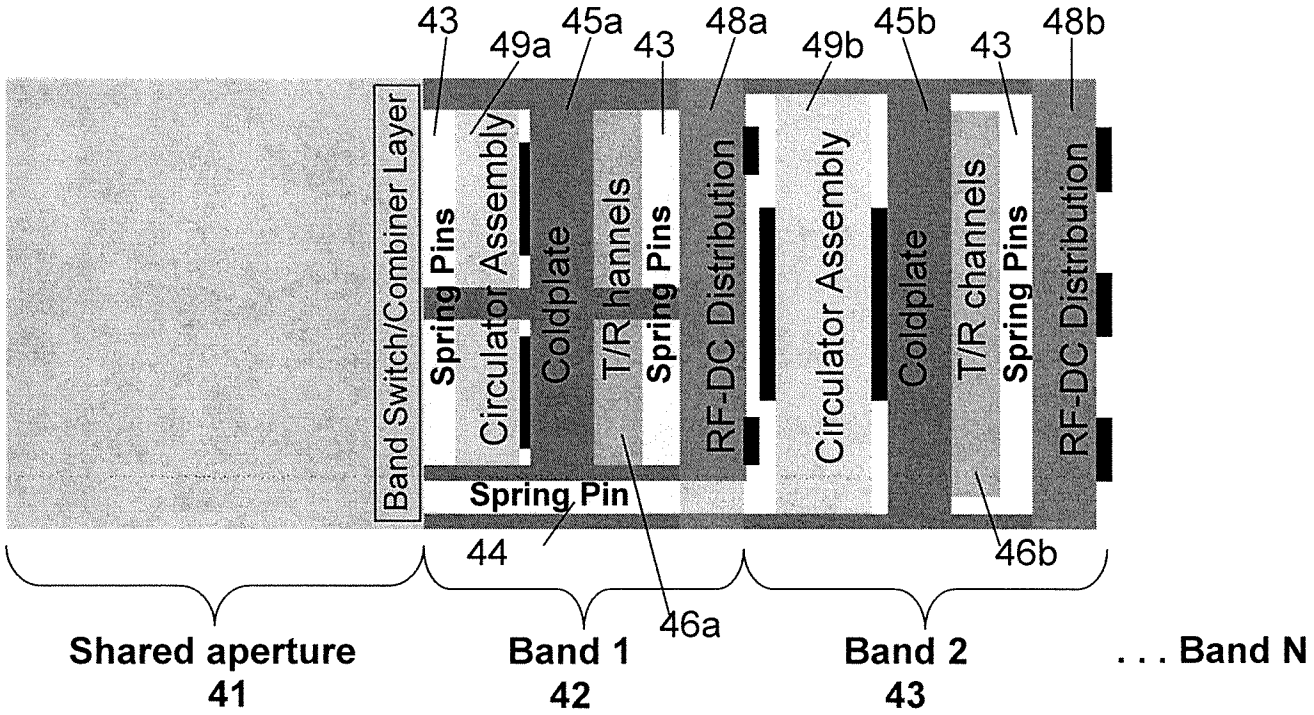
FIG. 4 is a simplified diagram of electronic layers behind a shared aperture, according to some embodiments of the present invention.

FIG. 4 is a simplified diagram of electronic layers behind a shared aperture, according to some embodiments of the present invention. As shown, an aperture 41 is shared by the band 1 (42) and band 2 (43) electronic layers. The assembly components are interconnected using spring pins 43 and 44. Although, spring pins are used in this example for interconnecting the components (layers), other type of connecting parts, such as, blindmate connectors, fuzz buttons, flex jumpers, and/or other interconnect methods may be used to interconnect the components/layers.

A circulator assembly 49*a* for band 1 is located behind the shared aperture 41. The transmit/receive (T/R) channels and related electronics 46*a* of band 1 are separated from the circulator assembly 49*a* by a heat sinking layer, such as a cold plate 45*a*. RF-DC distribution circuits 48*a*, which may be on one or more PCBs are mounted behind the T/R channels 46*a*. Band 2 circulator assembly 49*b*, T/R channels 46*b* and RF-DC distribution circuits 48*b* are mounted behind band 1 assembly in a similar manner.

If there are more bands being used, their respective assemblies may be mounted in a similar fashion behind the band 2 assembly. In the case of more than two bands, the band switch or combiner would select between the multiple bands to connect to the respective selected band to the shared aperture 41. In some embodiments, the antenna array of the present invention provides dual polarization capability.

Figure 5:
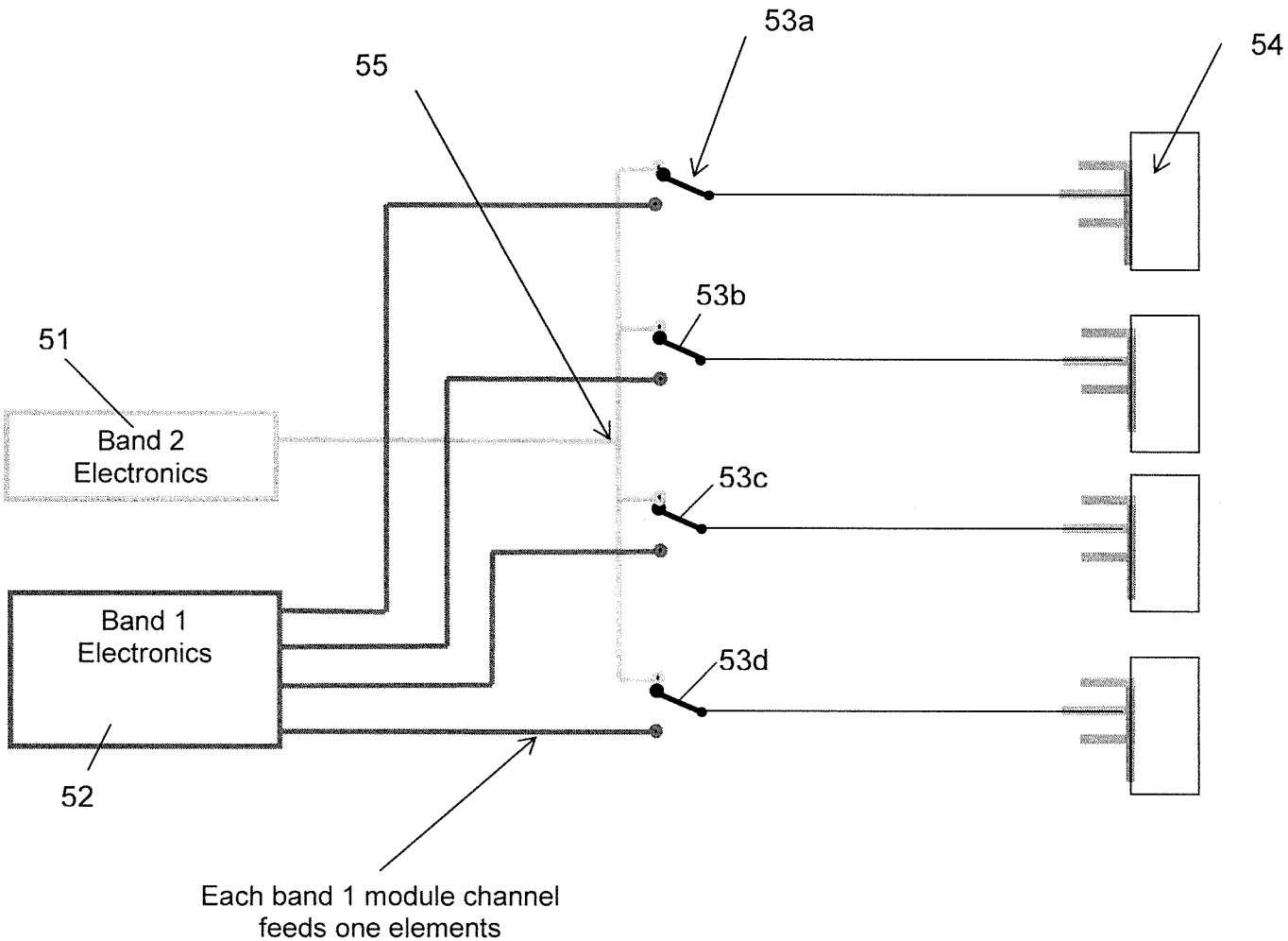
FIG. 5 is an exemplary schematic diagram for switching between the bands, according to some embodiments of the present invention.

FIG. 5 is an exemplary schematic diagram for switching between the bands, according to some embodiments of the present invention. As shown, band switches 53*a*, 53*b*, 53*c*, and 53*d* switch between band 1 and band 2 electronics to electrically couple the electronics of a selected band to the elements 54. In this example, there are four band switches shown (53*a*, 53*b*, 53*c*, and 53*d*), because there is a 4:1 ratio of the two frequency bands shown in this exemplary case. In this example, each band 2 channel goes through a four-to-one power divider 55 to feed the four individual elements 54. However, each band 1 channel feeds only one element. That is, the aperture element spacing is set by the higher frequency (band 1) and band 2 is over-sampled according to the ratio between the band frequencies. In this approach, either the band 1 or band 2 electronics are selected and coupled to the elements 54 at a given time.

Figure 6:
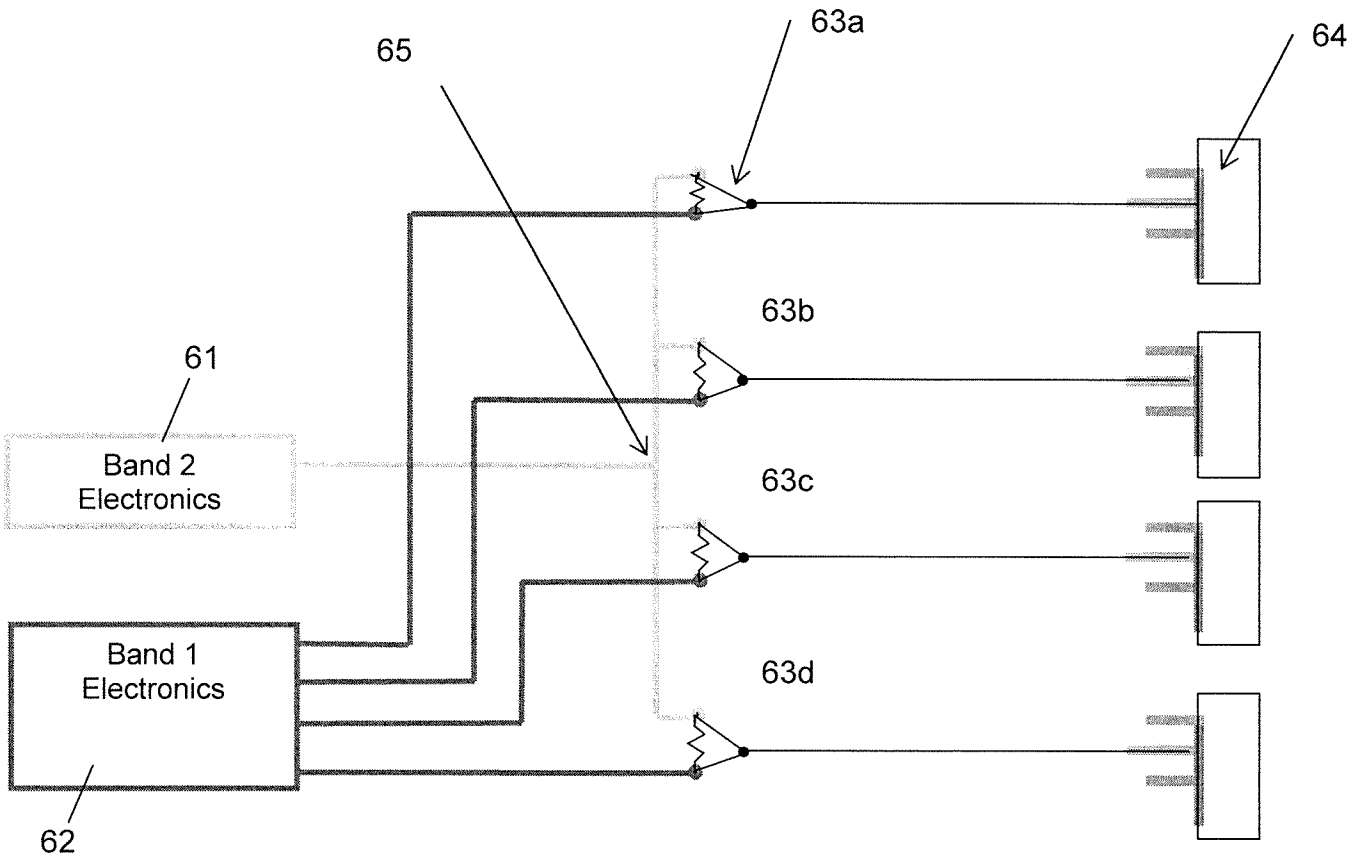
FIG. 6 is an exemplary schematic diagram for combining the bands, according to some embodiments of the present invention.

FIG. 6 is an exemplary schematic diagram for combining the bands, according to some embodiments of the present invention. As shown, combiners 63*a*, 63*b*, 63*c*, and 63*d* combine the band 1 and band 2 electronics to electrically couple the electronics of each band to the elements 64. In this example, each band 2 channel goes through a four-to-one power divider 65 to feed the four individual elements 64. However, each band 1 channel feeds only one element. In this approach it is possible to couple both band 1 and band 2 electronics simultaneously to the elements 64.

Figure 7:
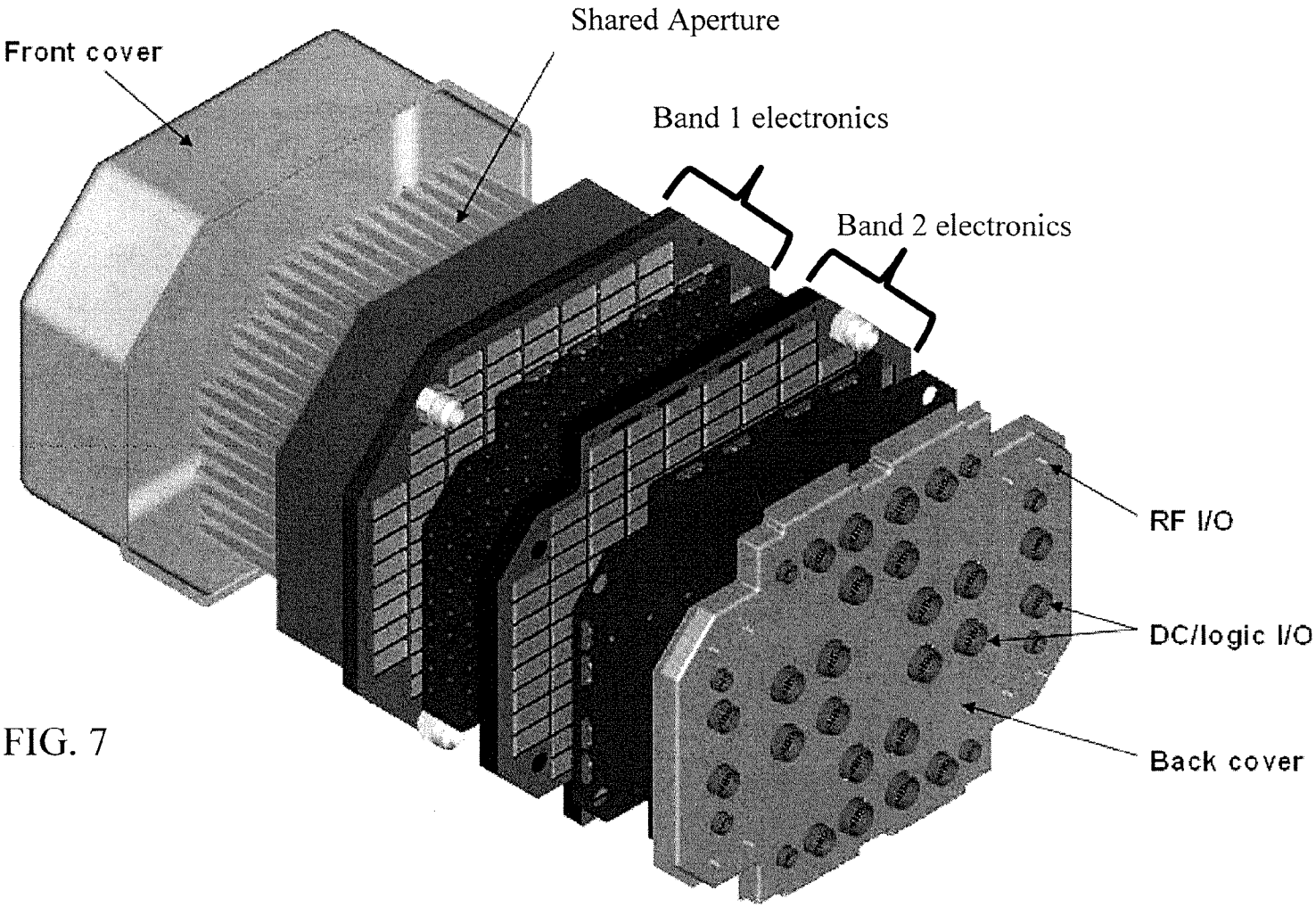
FIG. 7 is an exploded view of a multi-band AESA antenna, according to some embodiments of the present invention.

FIG. 7 is an exploded view of a multi-band AESA antenna, according to some embodiments of the present invention. As shown, band 1 and band 2 have different assemblies including the respective electronics. This provides for individual band testability, before or after they are assembled. The back cover includes the RF input/output and the DC/logic input/output. The individual assemblies are coupled together by screws, spring pins, and/or any suitable coupling means. The embodiment in FIG. 7 shows discrete components, coldplates, and PCBs. Other embodiments of this invention could have electronics packaged into one or multiple PCB assemblies.

The resulting, combined-bands antenna assembly of the present invention offers advantages of packaging volume reduction, weight reduction, and maximized aperture area for depth-challenged applications. The multi-band antenna of the present invention also presents dual polarization capability, enables low frequency circulator implementation for depth-challenged application, and reduces cost of parts and manufacturing.

It will be recognized by those skilled in the art that various modifications may be made to the illustrated and other embodiments of the invention described above, without departing from the broad inventive scope thereof. It will be understood therefore that the invention is not limited to the particular embodiments or arrangements disclosed, but is rather intended to cover any changes, adaptations or modifications which are within the scope and spirit of the invention as defined by the appended claims.

What is claimed is:

1. A multi-band electronically scanned array antenna comprising:

a first sub-assembly including electronic circuits of a first frequency band of said multi-band electronically scanned array antenna;

a second sub-assembly mechanically coupled to the first sub-assembly and including electronic circuits for a second frequency band; and an aperture adjacent to the first sub-assembly, the aperture being shared by the first sub-assembly and the second sub-assembly, wherein the first sub-assembly is positioned between the aperture and the second sub-assembly.

2. The multi-band electronically scanned array antenna of claim 1, further comprising a band switching circuit for coupling the first sub-assembly or the second sub-assembly to the aperture.

3. The multi-band electronically scanned array antenna of claim 1, further comprising a combining circuit for coupling the first sub-assembly or the second sub-assembly to the aperture.

4. The multi-band electronically scanned array antenna of claim 1, further comprising a third sub-assembly including electronic circuits for a third frequency band, wherein the aperture is shared by the first sub-assembly, the second sub-assembly, and the third sub-assembly.

5. The multi-band electronically scanned array antenna of claim 1, wherein the antenna is an Active Electronically Scanned Array (AESA) antenna.

6. The multi-band electronically scanned array antenna of claim 1, wherein the antenna is a Passive Electronically Scanned Array (PESA) antenna.

7. The multi-band electronically scanned array antenna of claim 1, wherein the electronics for the first frequency band and electronics for the second frequency band are mounted on two or more separate printed circuit boards.

8. The multi-band electronically scanned array antenna of claim 1, wherein each of the first and second assemblies include a separate circulator layer, a cold plate layer, transmit/receive channels, and RF-DC distribution layer and coupling means positioned on top of each other.

9. The multi-band electronically scanned array antenna of claim 1, further comprising electrical interconnect means positioned between only the first sub-assembly and the aperture.

10. The multi-band electronically scanned array antenna of claim 1, further comprising a cover coupled to the second sub-assembly.

11. The multi-band electronically scanned array antenna of claim 2, wherein the band switching circuit for coupling the first sub-assembly or the second sub-assembly to the aperture is selectable.

12. The multi-band electronically scanned array antenna of claim 1, wherein the first frequency band is a higher frequency than the second frequency band.

13. A multi-band electronically scanned array antenna comprising:

a first sub-assembly including a first transmitter/receiver circuit for transmitting and receiving a first frequency band of said multi-band electronically scanned array antenna;

a second sub-assembly mechanically coupled to the first sub-assembly and including a second transmitter/receiver circuit for transmitting and receiving a second frequency band of said multi-band electronically scanned array antenna;

an aperture adjacent to the first sub-assembly, the aperture being shared by the first sub-assembly and the second sub-assembly, wherein the first sub-assembly is positioned between the aperture and the second sub-assembly; and a band switching circuit coupled between the first sub-assembly and the aperture for electrically coupling the first sub-assembly or the second sub-assembly to the aperture.

14. The multi-band electronically scanned array antenna of claim 13, further comprising a cover coupled to the second sub-assembly.

15. The multi-band electronically scanned array antenna of claim 13, wherein the band switching circuit is selectable.

16. The multi-band electronically scanned array antenna of claim 13, wherein the first frequency band is a higher frequency than the second frequency band.

17. The multi-band electronically scanned array antenna of claim 13, wherein the antenna is an Active Electronically Scanned Array (AESA) antenna.

18. The multi-band electronically scanned array antenna of claim 13, wherein the antenna is a Passive Electronically Scanned Array (PESA) antenna.

19. The multi-band electronically scanned array antenna of claim 13, wherein the first sub-assembly further includes a first circulator and the second sub-assembly further includes a second circulator different from the first circulator.

20. The multi-band electronically scanned array antenna of claim 13, wherein the first sub-assembly further includes a first transmitter/receiver switch and the second sub-assembly further includes a second transmitter/receiver switch.

* * * * *